US005453810A

United States Patent [19]

Todoki

[11] Patent Number: 5,453,810

[45] Date of Patent: Sep. 26, 1995

[54] LEADER STOCKER AND LEADER STOCKER ASSEMBLY

[75] Inventor: Kenji Todoki, Wakayama, Japan

[73] Assignee: Noritsu Koki Co., Ltd., Wakayama, Japan

[21] Appl. No.: 219,882

[22] Filed: Mar. 30, 1994

[30] Foreign Application Priority Data

Mar. 31, 1993 [JP] Japan ..... 5-073152

[51] Int. Cl.[6] ..... G03D 3/08

[52] U.S. Cl. ..... 354/319; 354/321; 354/339

[58] Field of Search ..... 354/297, 319, 354/320, 321, 345, 339, 340; 226/90–92

[56] References Cited

FOREIGN PATENT DOCUMENTS 0158806 10/1985 European Pat. Off. .

0251338 1/1988 European Pat. Off. .

4-95953 3/1992 Japan ..... 354/323

6-67395 3/1994 Japan ..... 354/319

6-67396 3/1994 Japan ..... 354/319

*Primary Examiner*—D. Rutledge

*Attorney, Agent, or Firm*—Wenderoth, Lind & Ponack

[57] ABSTRACT

A leader stocker is located at a discharge end of a leader carrier path in an automatic film developing machine for storing leaders with films coupled thereto. The leader stocker is a case that has a bottom opening for receiving leaders therethrough. A plurality of pairs of vertically extending leader supports are provided in the case. Each pair is provided for receiving a leader in the case. A detent is located at a lower end of each vertically extending leader support in order to allow leaders that are inserted into the case to move upwardly along the leader supports and then to prevent the leaders from moving downwardly in the case.

17 Claims, 9 Drawing Sheets

LEADER STOCKER AND LEADER STOCKER ASSEMBLY

BACKGROUND OF THE INVENTION

This invention relates to a leader stocker used to stock leaders to which developed films are connected and an arrangement for feeding the leaders into the leader stocker.

Ordinarily, when a film is developed by an automatic film developing machine, a thin and flat leader having holes is connected to two films in order to guide the films to the developing unit.

In the automatic film developing machine, a stock unit is provided at a film outlet, and developed and dried negative films are fed from the film outlet to the stock unit and then piled.

In the conventional arrangement, the leaders with films are piled one upon another in a very disorderly manner. Thus, the films were liable to have a fold or become damaged when taken out of the stock unit.

SUMMARY OF THE INVENTION

It is an object of the present invention to provide a leader stocker and a leader stock assembly in which developed films having leaders can be piled and stocked in order.

According to the present invention, there is provided a leader stocker for storing leaders with films coupled thereto, the leader stocker comprising a case, a plurality of pairs of leader supports provided in the case at each side thereof and spaced apart from one another by a predetermined interval, each pair of the leader supports adapted to support the leader at both sides thereof, and detent means provided for each of the leader supports for allowing the leader to move along the leader support forwardly into the leader stocker and for preventing the leader from moving in an opposite direction.

Further, there is provided a leader stocker assembly provided at a carrier end of the leader carrier path in an automatic film developing machine, the leader stocker assembly comprising a leader stocker as described above, a stocker holder for removably holding the leader stocker so that one of the leader supports is opposite to the carrier end, leader feeding means for feeding the leader along the leader support until the leader fed from the carrier end to the leader stocker has passed through the detent means, and transfer means for transferring the stocker holder to a direction perpendicular to a direction in which the leader is fed every time the leader has passed the detent means, to move the next leader support to a position opposite to the carrier end of the leader carrier path.

The leader stocker is held in the stocker holder. The leader, fed from the leader carrier path of the automatic film developing machine, is supported at both sides thereof by a pair of leader supports and then transmitted along the leader support driven by the leader feeding mechanism. In this state, the detent means permits the leader to move forward without intervening. After the leader has passed the detent means, the detent means prevents the leader from moving in the opposite direction. The transfer means serves to move the stocker holder in a direction perpendicular to the carrier direction of the leader. The next leader support is placed opposite to the carrier exit of the leader carrier path. The next leader is then fed to this leader support. The same operation is repeated.

The developed film leader can be automatically and continuously stocked one by one in an orderly manner in each leader support in the leader stocker. Moreover, as each film is held hanging down from the leader, no fold or damage develops.

Furthermore, a plurality of films having leaders are stocked in the leader stocker. Thus, the film can be easily passed onto a film printing apparatus and reliably stored.

BRIEF DESCRIPTION OF THE DRAWINGS

Other objects and features of the present invention will become apparent from the following description taken with reference to the accompanying drawings, in which.

DETAILED DESCRIPTION OF THE PREFERRED EMBODIMENT

Figure 1:
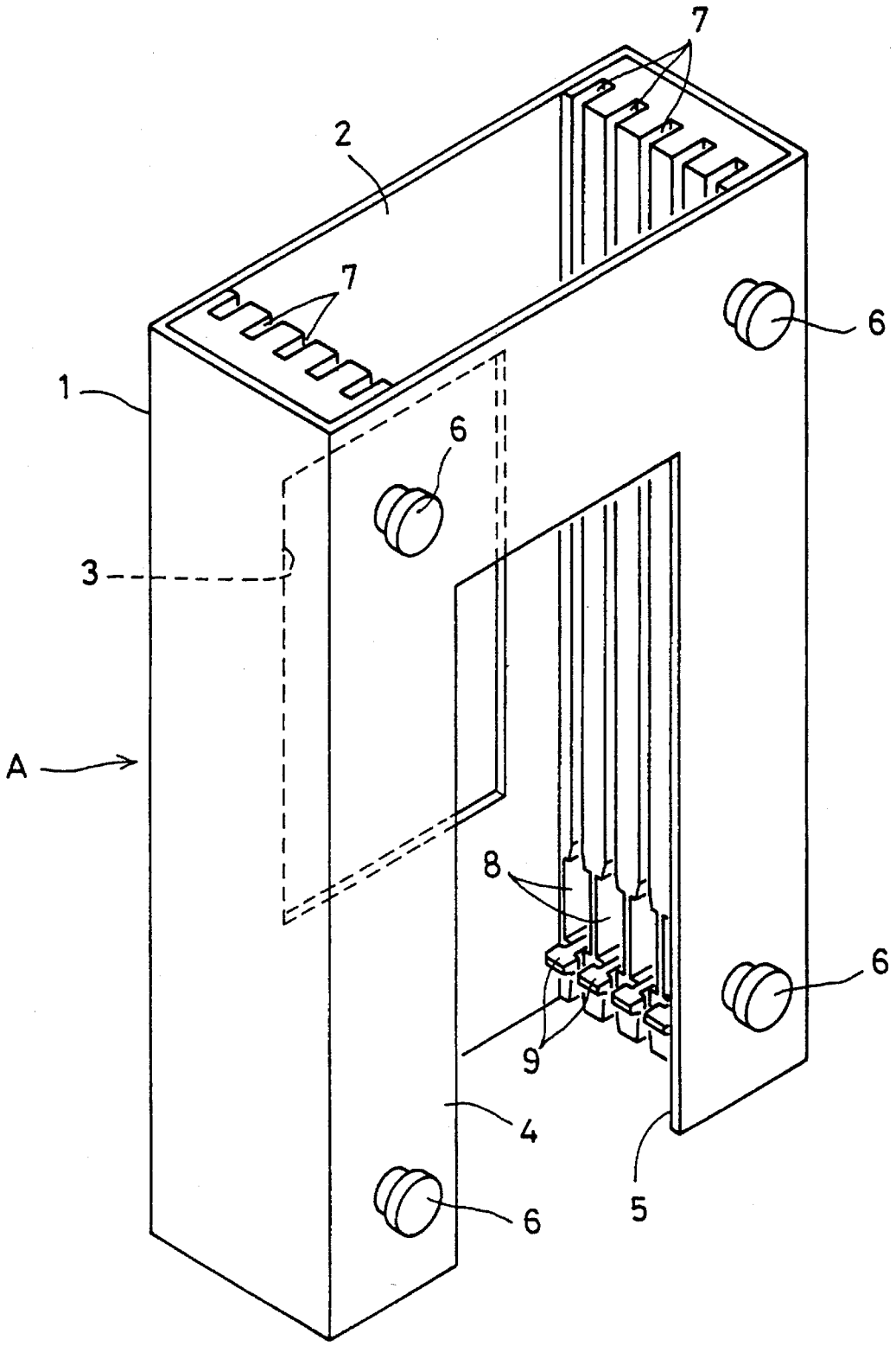
FIG. 1 is a perspective view of a leader stocker according to the present invention.
Figure 2:
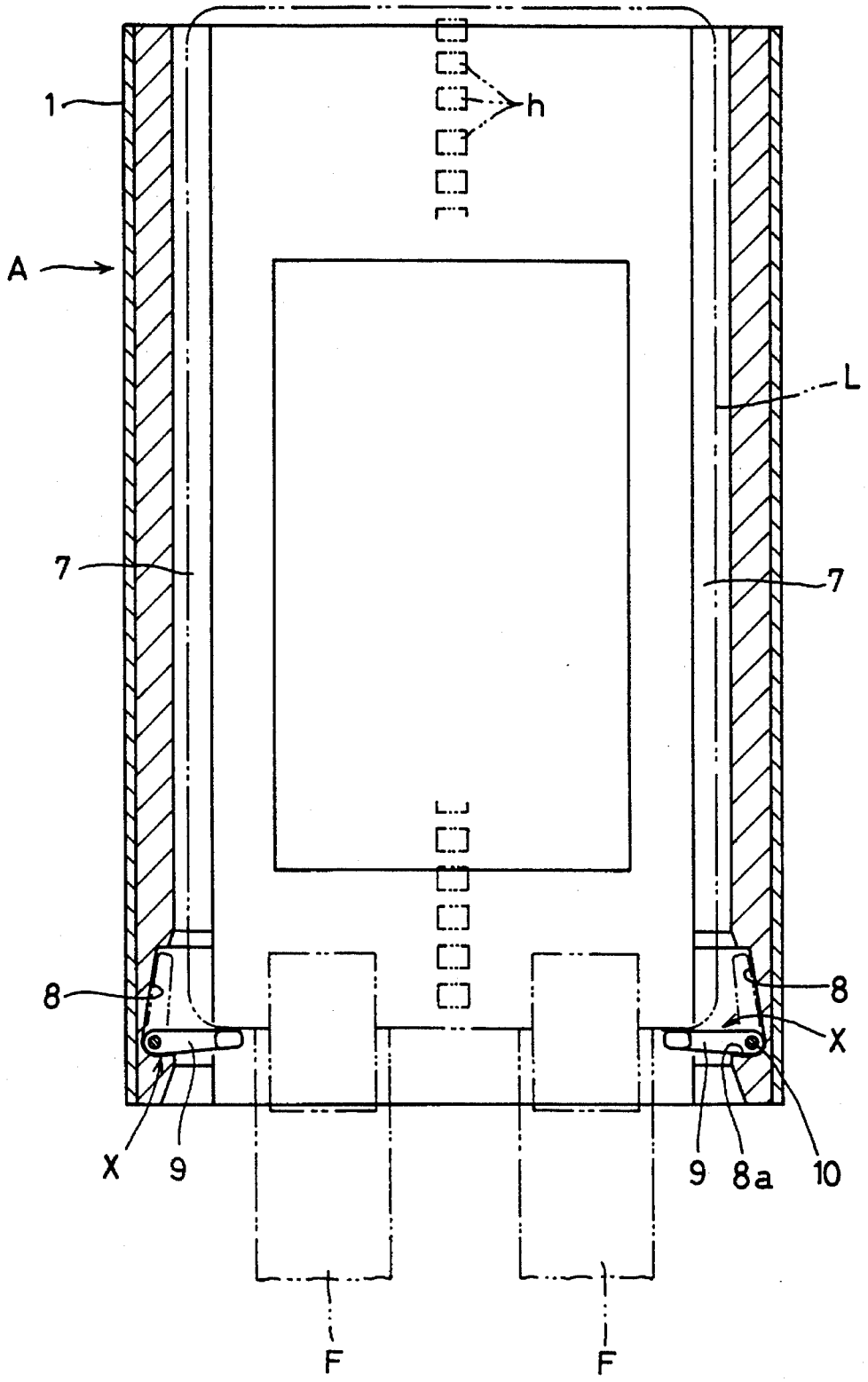
FIG. 2 is a sectional front view of the same.
Figure 3:
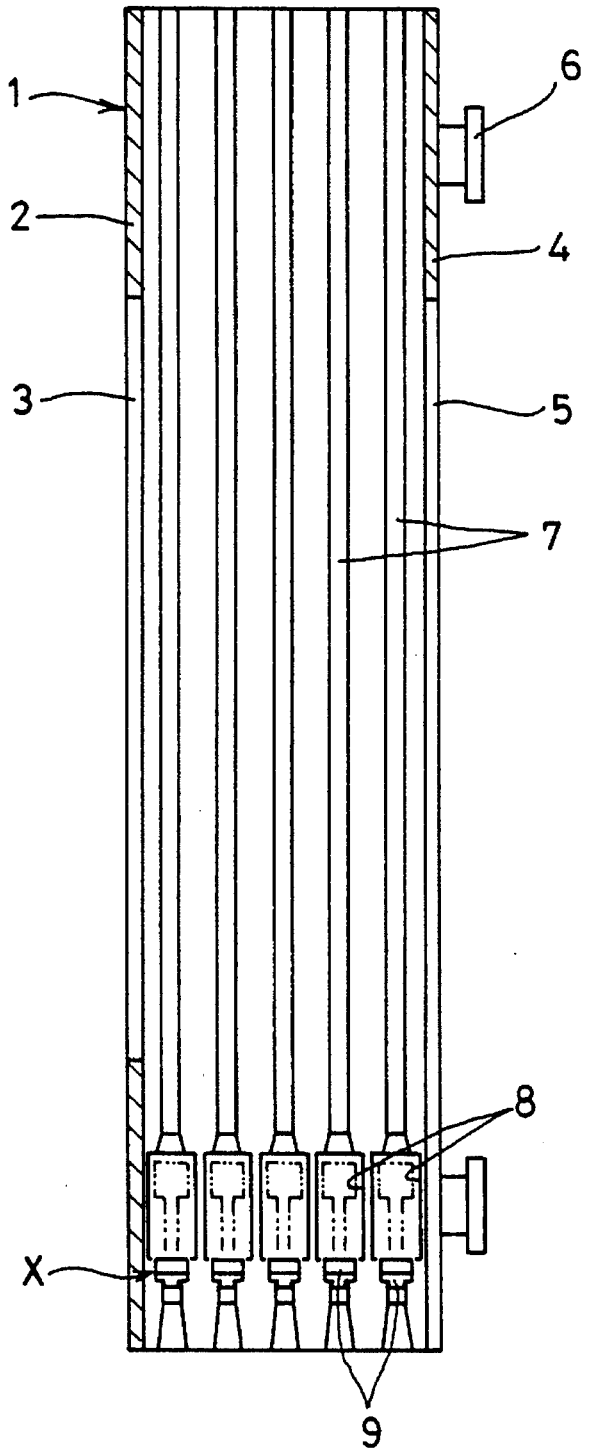
FIG. 3 is a sectional side view of the same.

FIGS. 1–3 show a leader stocker embodying the present invention. A case 1 is in the form of a rectangular cylinder having its top and bottom ends open. A front plate 2 of the case 1 is provided with a window 3. A rear plate 4 is formed with an opening 5 and engaging pins 6 at four corners thereof.

At both sides of the interior of the case 1 are provided a plurality of pairs of leader supports 7. Each leader support 7 is in the form of a plurality of groove spaced apart a predetermined interval so as to support both sides of a leader L.

At the bottom end of each leader support 7 is provided a detent means X permitting the leader L to move upward from the bottom end of the leader supports 7 but preventing it from moving downward.

The detent means X comprises a claw 9 mounted in a recess 8 provided at the bottom end of the leader support 7. The rear end of the claw 9 is pivotably supported by a pin 10. By engaging the claw 9 against a bottom surface 8*a* of the recess 8, it maintains a horizontal position with its tip portion disposed in the leader support 7. It can pivot upwardly from the horizontal position (FIG. 2).

The leader L is made from a synthetic resin sheet for flexibility. At the center of its width direction are formed a plurality of holes h equally spaced from one another. Two films F are connected to the bottom end of the leader L.

FIGS. 4–7 show an arrangement for feeding leaders L into a leader stocker. Numeral 20 is an automatic film developing machine and 21 is a carrier path of the leader L shown in FIG. 2. Through the carrier path 21, a developing unit (not shown) and a drying unit 22 for drying the developed film F are provided.

Downstream of the carrier path 21 is provided a delivery mechanism 25 which delivers the leader L and the developed film F connected thereto from a film outlet 23 formed at one side of the top of the automatic film developing machine 20 to a stocker unit 24.

The delivery mechanism 25 comprises a plurality of roller units U spaced apart from one another by a smaller distance than the entire length of the leader L. The roller unit U comprises a pair of rollers 26*a* and 26*b* for feeding films and a sprocket 27 which is coaxial with the roller 26*a* and engages with the holes h in the leader L. The rollers 26*a* and 26*b* are rotated by a driving device (not shown) in opposite directions.

A leader carrier path 28 branches from the carrier path 21 at its downstream end. At the joint portion of the leader carrier path 28 and the carrier path 21 is provided a select arm 29, which pivoted by a rotary solenoid 30 connected to its top. Thus, it can change over the carrier direction of the leader L according to the kind of film F fed along the carrier path 21.

In the embodiment, films F of a 135 size are guided to the leader carrier path 28, while other films F are fed along the carrier path 21.

Figure 4:
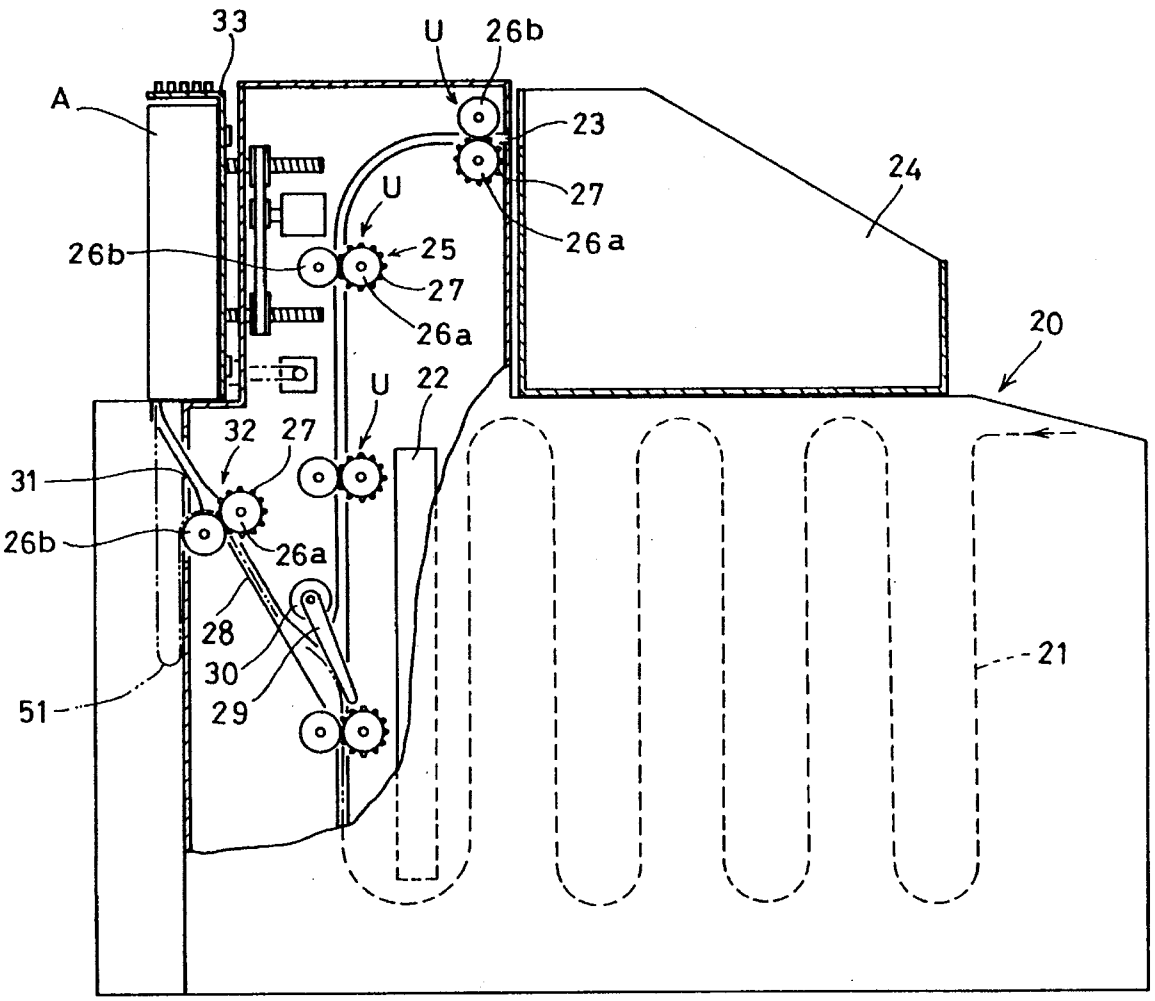
FIG. 4 is a schematic view showing one embodiment of a arrangement for feeding leaders into the leader stocker.

The leader carrier path 28 extends toward a second film outlet 31 that is formed at the other side of the top of the automatic film developing machine 20 (FIG. 4). The carrier exit protrudes outside of the film outlet 31. The leader carrier path 28 is provided with a delivery mechanism 32. Since it has the same structure as the delivery mechanism 25 provided along the carrier path 21, like parts are denoted by like numerals, and their description is omitted.

Figure 6:
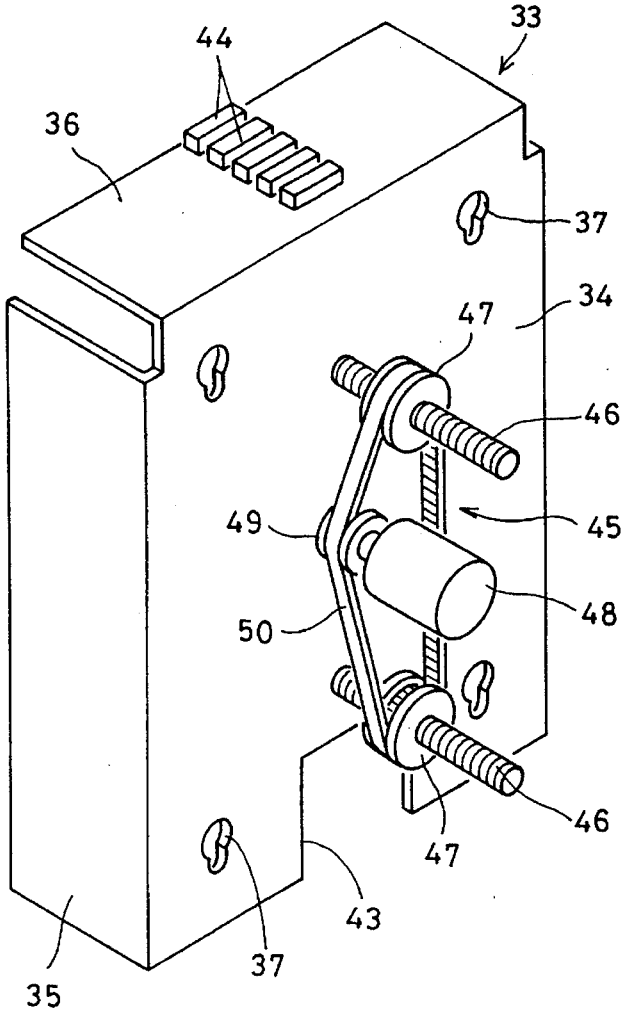
FIG. 6 is a perspective view showing a transfer means of the same.

Above the exit of the carrier path 28 is provided a stocker holder 33 to hold the leader stocker A removably. As shown in FIG. 6, the stocker holder 33 comprises a support 34, a pair of side plates 35 at both sides thereof and a top plate 36 at its top. The support 34 is formed with a plurality of guitar-shaped holes 37 to receive engaging pins 6 so that the leader stocker A can be accommodated in the stocker holder 33. In this state, the carrier exit of the leader carrier path 28 is disposed at the bottom opening of the case 1, and one of the leader supports 7 opposes the carrier exit.

Figure 7:
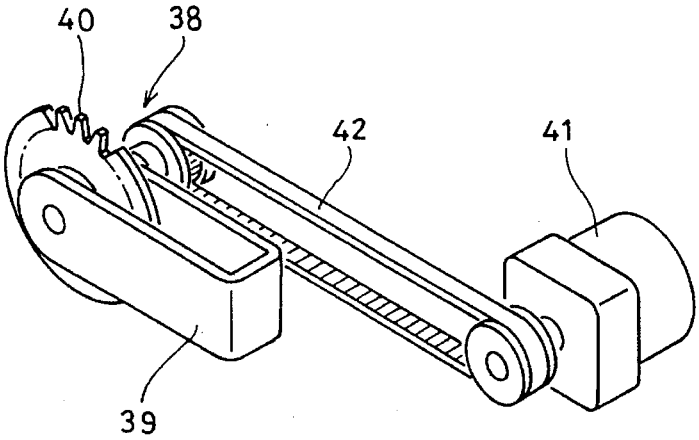
FIG. 7 is a perspective view of a leader feeding means of the same.

The leader L fed from the leader carrier path 28 to the leader support 7 is guided upward along the leader support 7 by a leader feeding means 38 shown in FIG. 7. It comprises an arm 39, a sprocket 40 rotatably supported on the tip of the arm 39, a motor 41 for driving the sprocket 40, and a belt transmission 42 for transmitting the rotation of the motor 41 to the sprocket 40.

Figure 5:
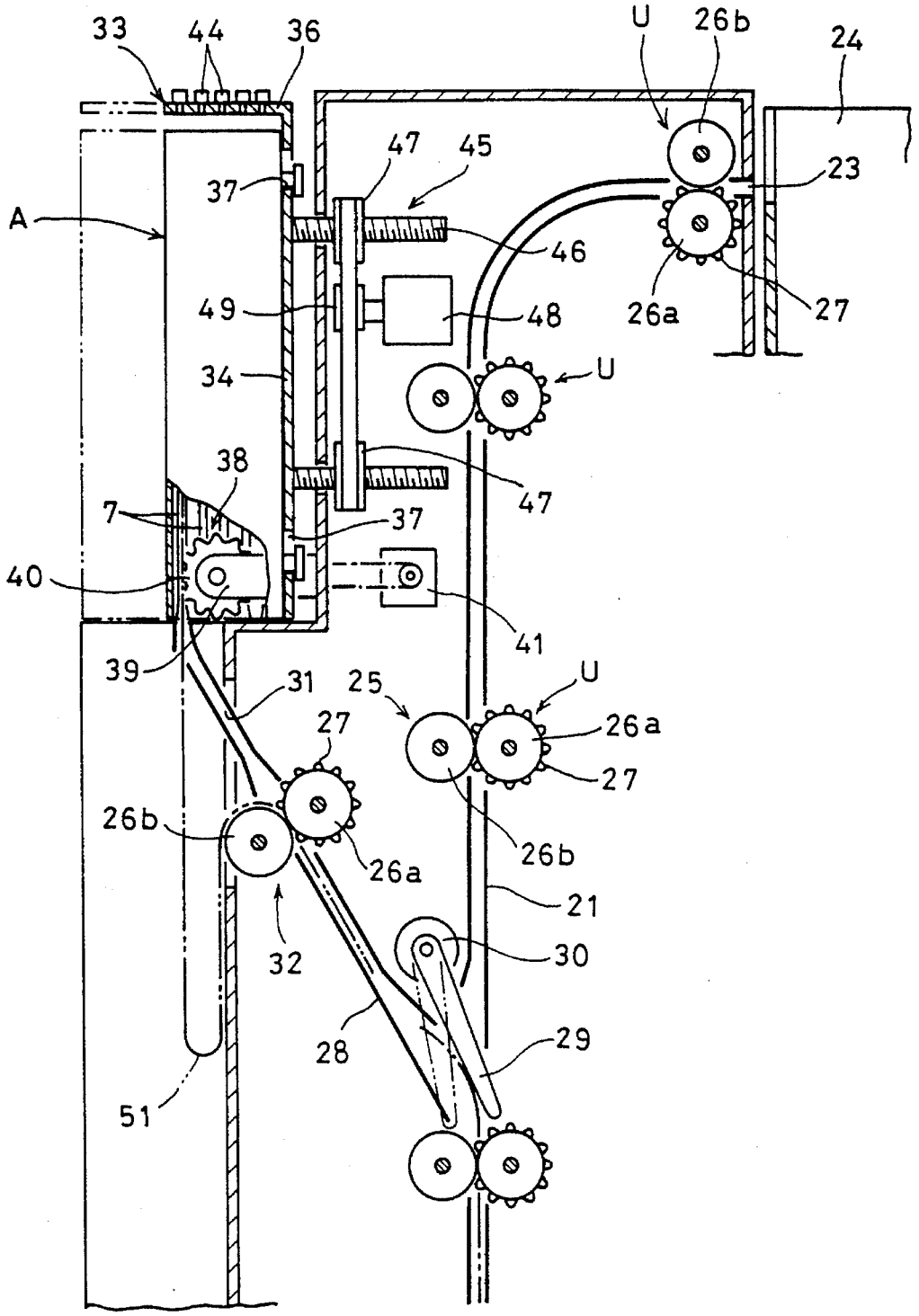
FIG. 5 is a partially enlarged sectional view of the same.

As shown in FIGS. 5 and 6, the leader feeding means 38 is mounted so that the arm 39 extends through a cutout 43 formed in the support 34 of the stocker holder 33 and so that the sprocket 40 can engage in holes h in the leader L fed upward from the carrier exit of the leader carrier path 28. Therefore, the leader L fed from the leader carrier path 28 to the leader support 7 is fed further upward by the rotation of the sprocket 40.

A plurality of sensors 44 are mounted on the top plate 36 of the stocker holder 33. Each sensor 44 is placed so as to be opposite one of the respective leader supports 7 in the leader stocker A accommodated in the stocker holder 33. Each sensor 44 detects whether or not a leader L has been fed to the leader support 7.

The stocker holder 33 is moved by a distance corresponding to the pitch between the leader supports 7, being driven by a transfer means 45 that is activated in response to signals from the sensor 44.

FIG. 6 shows the transfer means 45. It comprises a plurality of threaded shafts 46 fixed to the rear surface of the support 34 of the stocker holder 33. Pulleys 47 having a threaded hole are brought into threaded engagement with the threaded shafts 46. A timing belt 50 is placed on the pulleys 47 through a driving pulley 49 mounted on a revolving shaft of a motor 48. With this transfer means 45, the pulleys 47 are rotatably supported in the automatic film developing machine 20 and the threaded shafts 46 are moved in the axial direction by the rotation of the pulleys 47.

With the above-described arrangement, in order to stock the leaders L fed from the leader carrier path 28 of the automatic film developing machine 20, the leader stocker A is mounted in the stocker holder 33.

Supposing that the leader L is carried along the carrier path 21 and the films F connected to the leader L are of a 135 size, then the select arm 29 will guide the leader L to the leader carrier path 28. Films F having other sizes will continue to move along the carrier path 21.

When the leader L is fed to the leader carrier path 28, it is fed to its carrier exit 31, guided by the delivery mechanism 32. In this state, one of the leader supports 7 of the leader stocker A mounted in the stocker holder 33 is opposite to the carrier exit of the leader carrier path 28. Thus, the leader L fed from the carrier exit of the leader carrier path 28 is fed to the leader support 7 opposite to the carrier exit and then fed upward by the rotation of the sprocket 40 provided at one end of the path.

When feeding the leader L in the leader stocker A, the claw 9 provided at the leader support 7 pivots upward, pushed by the leader L. After the leader L has passed, the claw 9 pivots downward and is supported at the bottom surface 8*a*.

If the sensor 44 detects that the leader L has been fed into the leader support 7, the sprocket 40 will halt its rotation. In this state, the film F following the leader L is fed further by the delivery mechanism 32, forming a loop 51 under the leader stocker A. When the film F has passed through the delivery mechanism 32, the loop 51 hangs downward from the leader stocker A.

If the sensor 44 detects that the leader L has been fed into the leader support 7, the transfer means 45 operates to move the stocker holder 33 by one pitch, so that the next leader support 7 is placed at the position opposite to the carrier exit of the leader carrier path 28. Thus, the next leader L fed from the leader carrier path 28 can be fed to the leader support 7.

The same operation is repeated. The leader L fed to the leader stocker A is supported by the claw 9 to prevent from dropping.

A leader L fed along the carrier path 21 is fed from the film outlet 23 to the stocker 24, placing one on another.

FIGS. 8–10 show other examples of the detent means X.

Figure 8A:
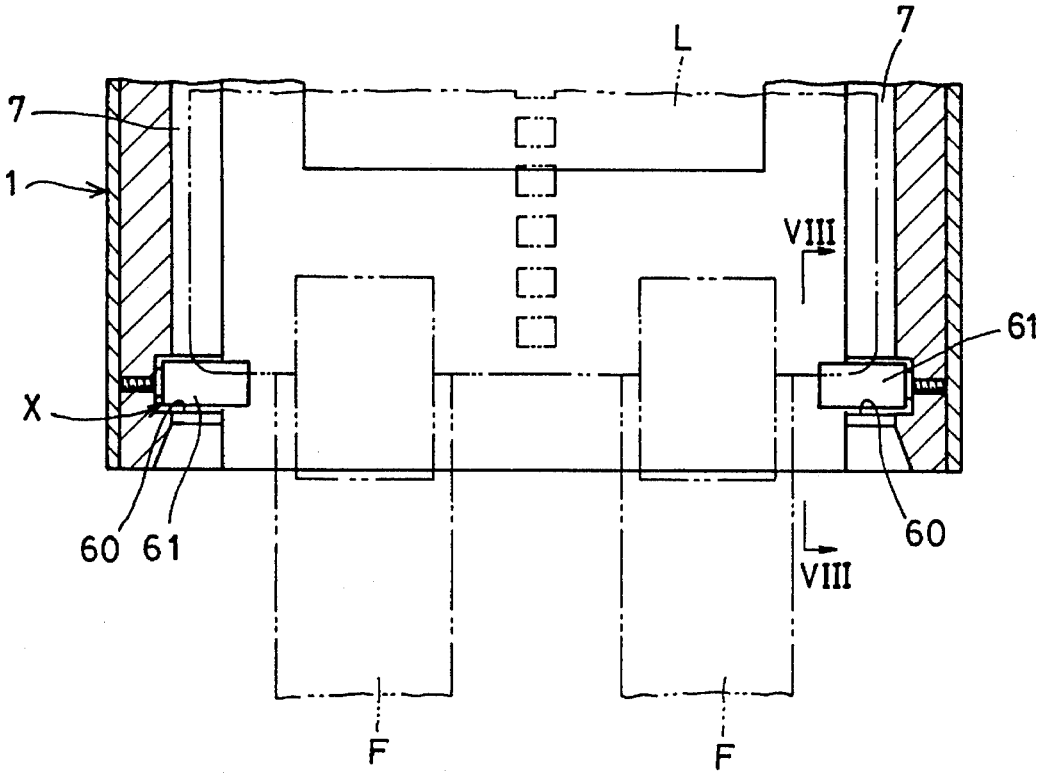
FIG. 8A is a sectional view showing another example of a detent means.
Figure 8B:
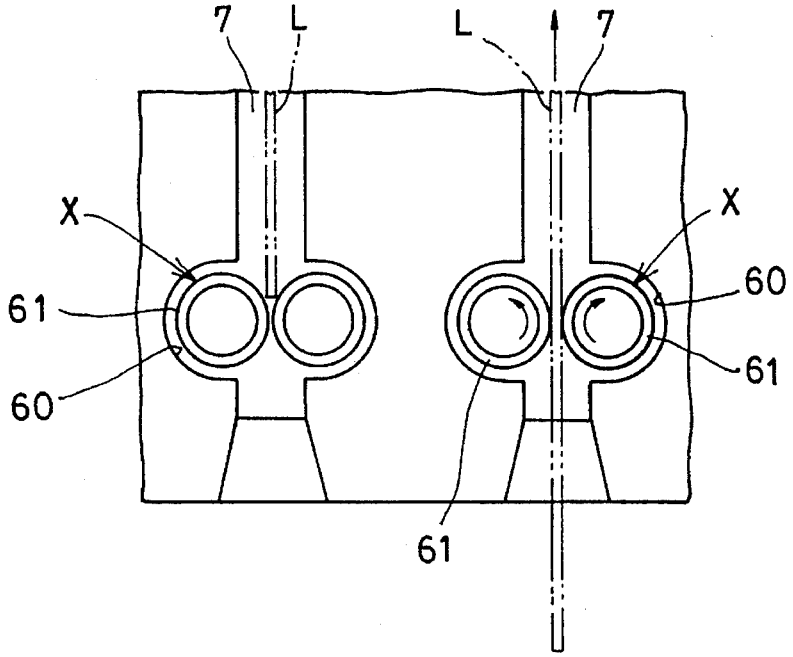
FIG. 8B is a sectional view taken along line VIII—VIII of FIG. 8A.

In the detent means X shown in FIGS. 8A and 8B, the leader support 7 has at both sides of its bottom a pair of roller housing recesses 60 each of which accommodates a one-way roller 61.

Each one-way roller 61 contains a one-way clutch (not shown). The leader L is inserted between the contact portions of the one-way roller 61. When the leader L is moved upward, the one-way rollers 61 rotate in the direction of arrow shown in FIG. 8B due to contact with the leader L, but not in the opposite direction.

Figure 9A:
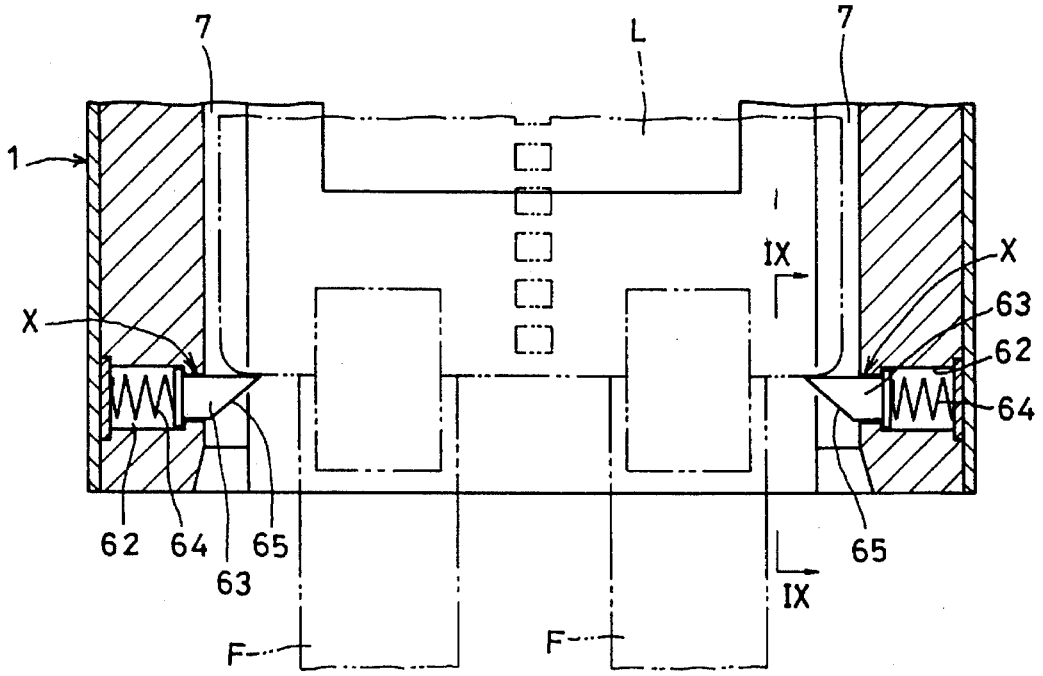
FIG. 9A is a sectional view showing still another example of a detent means.
Figure 9B:
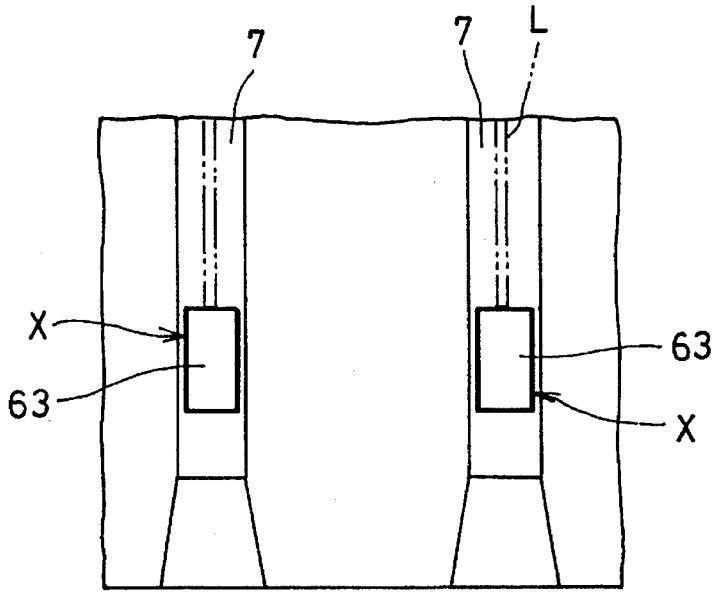
FIG. 9B is a sectional view taken along line IX—IX of FIG. 9A.

With the detent means X shown in FIGS. 9A and 9B, the leader support 7 has at one side of the bottom thereof a pin hole 62, a detent pin 63 and a spring 64 which presses the detent pin 63 toward the leader support 7. A tapered surface 65 is formed at the bottom surface of the detent pin 63 disposed in the leader support 7.

With this detent means X, when the leader L is inserted from the bottom of the leader support 7, the detent pin 63 retracts as the leader L pushes the tapered surface 65 of the pin 63, allowing the leader L to move upward. After the bottom end of the leader L has passed through the detent pin 63, the detent pin moves forward until its tip portion is disposed in the leader support 7, preventing the leader L from moving downward.

Figure 10A:
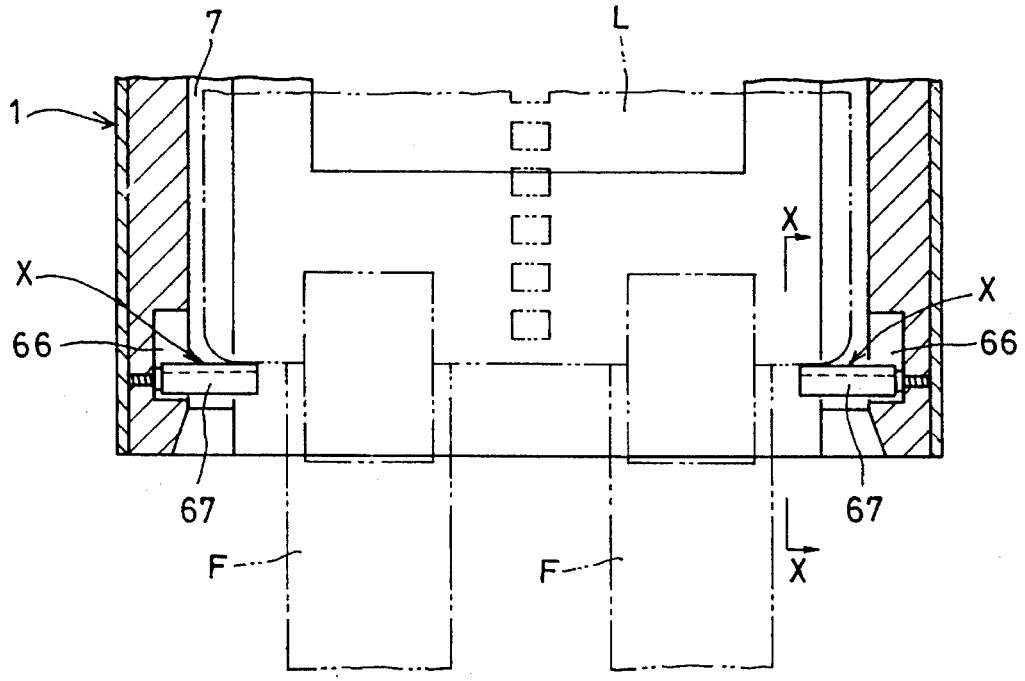
FIG. 10A is a sectional view showing a further example of a detent means.
Figure 10B:
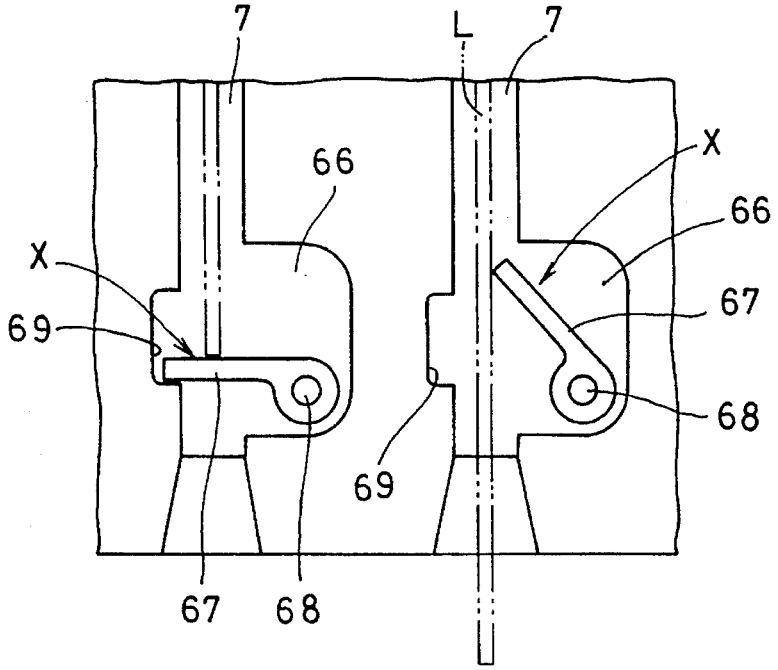
FIG. 10B is a sectional view taken along line X—X of FIG. 10A.

The arrangement of the detent means X shown in FIGS. 10A and 10B is that a recess 66 is formed at one side of the lower part of the leader support 7 to accommodate a claw 67. The rear end of the claw is pivotably supported by a pin 68. At the other side of the lower part of the leader support 7 is formed an engaging recess 69 to receive the tip of the claw 67. When the leader L moves upward from the bottom end of the leader support 7, the claw 67 pivots upward. After the leader L has passed through the claw 67, it will pivot downward and its bottom end engage with the bottom face of the engaging recess 69, preventing the leader L from moving downward.

What is claimed is:

1. A leader stocker located at a discharge end of a leader carrier path in an automatic film developing machine for storing leaders with films coupled thereto, said leader stocker comprising:

a case having a bottom opening for receiving leaders therethrough, said case having opposite sides;

a plurality of pairs of vertically extending leader supports in said case, wherein each of said pairs comprises one of said leader supports on one of said opposite sides and another of said leader supports on the other of said opposite sides and the one and the other of said leader supports of each of said pairs being spaced apart from each other a predetermined distance such that each of said pairs of leader supports can support both sides of a leader; and detent means located at lower ends of said plurality of vertically extending leader supports for allowing leaders inserted into said case to move upwardly into and along said leader supports through said bottom opening and for preventing the leaders from moving downwardly in said case.

2. The leader stocker of claim 1, wherein each of said pairs of leader supports comprises a vertical groove located on each of said sides.

3. The leader stocker of claim 2, wherein said detent means comprises a movable member located at a bottom end of each of said grooves, said movable member being movable into and out of a position obstructing a leader path defined between said grooves of each of said pairs of leader supports.

4. The leader stocker of claim 3, wherein said movable member is a pivoting member pivotable into and out the leader path.

5. The leader stocker of claim 3, wherein said movable member is a detent pin spring biased into the position obstructing the leader path and having a tapered bottom surface.

6. The leader stocker of claim 2, wherein said detent means comprises a pair of unidirectionally rotatable rollers located at a bottom end of each of said grooves at a position in a leader path defined between said grooves of each of said pairs of leader supports.

7. A leader stocker assembly located at a carrier end of a leader carrier path in an automatic film developing machine, said leader stocker assembly comprising:

a case having a bottom opening for receiving leaders therethrough, said case having opposite sides, a plurality of pairs of vertically extending leader supports in said case, wherein each of said pairs comprises one of said leader supports on one of said opposite sides and another of said leader supports on the other of said opposite sides and the one and the other of said leader supports of each of said pairs being spaced apart from each other a predetermined distance such that each of said pairs of leader supports can support both sides of a leader, and detent means located at lower ends of said plurality of vertically extending leader supports for allowing leaders inserted into said case to move upwardly into and along said leader supports through said bottom opening and for preventing the leaders from moving downwardly in said case;

a stocker holder removably holding said leader stocker such that one of said pairs of leader supports is located opposite to said carrier end;

a leader feeding means for feeding a leader along said pairs of leader supports until the leader, having been fed from said carrier end to said leader stocker, has passed through and past said detent means; and transfer means for transferring said stocker holder in a direction perpendicular to the direction of feed of a leader into said leader stocker each time a leader has passed said detent means so as to move a next one of said pairs of leader supports into a position located opposite to said carrier end of said carrier path.

8. A leader stocker, comprising:

a case having a bottom opening for receiving leaders therethrough, said case having opposite sides;

a plurality of pairs of vertically extending leader supports in said case, wherein each of said pairs comprises one of said leader supports on one of said opposite sides and another of said leader supports on the other of said opposite sides, the one and the other of said leader supports of each of said pairs are spaced apart from each other a predetermined distance such that each of said pairs of leader supports can support both sides of a leader, and each of said pairs of leader supports defines a leader path for a leader in said case; and a detent located at a lower end of each of said plurality of pairs of vertically extending leader supports at a position in said leader path of each of said plurality of leader supports.

9. The leader stocker of claim 8, wherein each of said pairs of leader supports comprises a vertical groove located on each of said sides.

10. The leader stocker of claim 9, wherein said detent comprises a movable member located at a bottom end of each of said grooves, said movable member being movable into and out of a position obstructing said leader path, and said leader path being defined between said grooves of each of said pairs of leader supports.

11. The leader stocker of claim 10, wherein said movable member is a pivoting member pivotable into and out of said leader path.

12. The leader stocker of claim 10, wherein said movable member is a detent pin spring biased into the position obstructing said leader path and having a tapered bottom surface.

13. The leader stocker of claim 9, wherein said detent comprises a pair of unidirectionally rotatable rollers located at a bottom end of each of said grooves at a position in said leader path, said leader path being defined between said grooves of each of said pairs of leader supports.

14. The leader stocker of claim 8, wherein said detent comprises a movable member movable into and out of a position obstructing said leader path.

15. The leader stocker of claim 14, wherein said movable member is a pivoting member pivotable into and out of said leader path.

16. The leader stocker of claim 14, wherein said movable member is a detent pin spring biased into the position obstructing said leader path and having a tapered bottom surface.

17. The leader stocker of claim 8, wherein said detent comprises a pair of unidirectionally rotatable rollers located in said leader path.

* * * * *